United States Patent [19]

Velasquez

[11] Patent Number: 4,831,670

[45] Date of Patent: May 23, 1989

[54] AUTOMATIC FLUSHING APPARATUS FOR TOILETS

[76] Inventor: Guadalupe Velasquez, 3505 E. Balch, Fresno, Calif. 93702

[21] Appl. No.: 29,241

[22] Filed: Mar. 23, 1987

[51] Int. Cl.[4] ..... E03D 5/04

[52] U.S. Cl. ..... 4/408

[58] Field of Search ..... 4/305, 313, 406, 408, 4/302

[56] References Cited

U.S. PATENT DOCUMENTS

| | | | |
|---|---|---|---|
| 2,635,691 | 4/1953 | Filliung | 4/406 X |
| 2,688,141 | 9/1954 | Filliung | 4/305 X |
| 2,813,274 | 11/1957 | Lewis et al. | 4/12 |
| 3,082,433 | 3/1963 | Armstrong et al. | 4/406 X |
| 3,134,986 | 6/1964 | Gelhar | 4/249 |
| 3,462,768 | 8/1969 | Lefebvre et al. | 4/406 |
| 3,590,397 | 7/1971 | Akamatsu et al. | 4/100 |
| 4,055,864 | 11/1977 | Liu et al. | 4/253 |
| 4,329,745 | 5/1982 | Aguero | 4/313 |
| 4,333,184 | 6/1982 | Wang | 4/408 X |
| 4,392,260 | 7/1983 | Bensen | 4/406 X |

FOREIGN PATENT DOCUMENTS

| | | | |
|---|---|---|---|
| 48505 | 5/1985 | Fed. Rep. of Germany | 4/313 |
| 7905534 | 1/1981 | Netherlands | 4/305 |

*Primary Examiner*—Charles E. Phillips

*Attorney, Agent, or Firm*—Baker, Maxham & Jester

[57] ABSTRACT

An apparatus for automatically flushing toilets includes an electric motor driven tripping mechanism, including a gear train with an arm for tripping the flush valve, and a control circuit having a first sub-circuit activated by weight on the toilet seat for activating the motor, and tripping mechanism for tripping a second circuit switch for readying a second circuit that is activated upon removal of the weight from the seat for activating the trip mechanism for tripping the flush valve.

12 Claims, 2 Drawing Sheets

AUTOMATIC FLUSHING APPARATUS FOR TOILETS

BACKGROUND OF THE INVENTION

The present invention relates to toilet bowl flushing systems and pertains particularly to automatic apparatus for automatically flushing toilets. Many people, adults as well as children, are negligent or forgetful in the flushing of manually flushed toilets. Many proposals have been made in the past for automatic flushing devices that purport to remedy this problem. Among the prior art approaches to this problem are the following U.S. patents:

| | | |
|---|---|---|
| Lewis et al. | 2,813,274 | Nov. 19, 1957 |
| Gelhar | 3,134,986 | June 2, 1964 |
| Akamatsu et al. | 3,590,397 | July 6, 1971 |
| Liu et al | 4,055,864 | Nov. 1, 1977 |
| Aguero | 4,329,745 | May 18, 1982 |

These proposals are not entirely satisfactory. It is therefore, desirable to have some means for reliably and automatically flushing toilet bowls following use.

SUMMARY AND OBJECTS OF THE INVENTION

It is the primary object of the present invention to provide an improved automatic toilet flushing system.

In accordance with a primary aspect of the present invention, an automatic flush apparatus for a waste bowl includes an actuating arm connected to a flush valve, power means for operating the actuating arm and control means for controlling the power means, including first means for mounting on a seat and responsive to a weight on the seat for enabling second means responsive to removal of said weight from said seat for activating the power means for operating said arm.

BRIEF DESCRIPTION OF THE DRAWING

The above and other objects and advantages of the present invention will become apparent from the following description when read in conjunction with the accompanying drawing wherein.

DETAILED DESCRIPTION OF A PREFERRED EMBODIMENT

Figure 1:
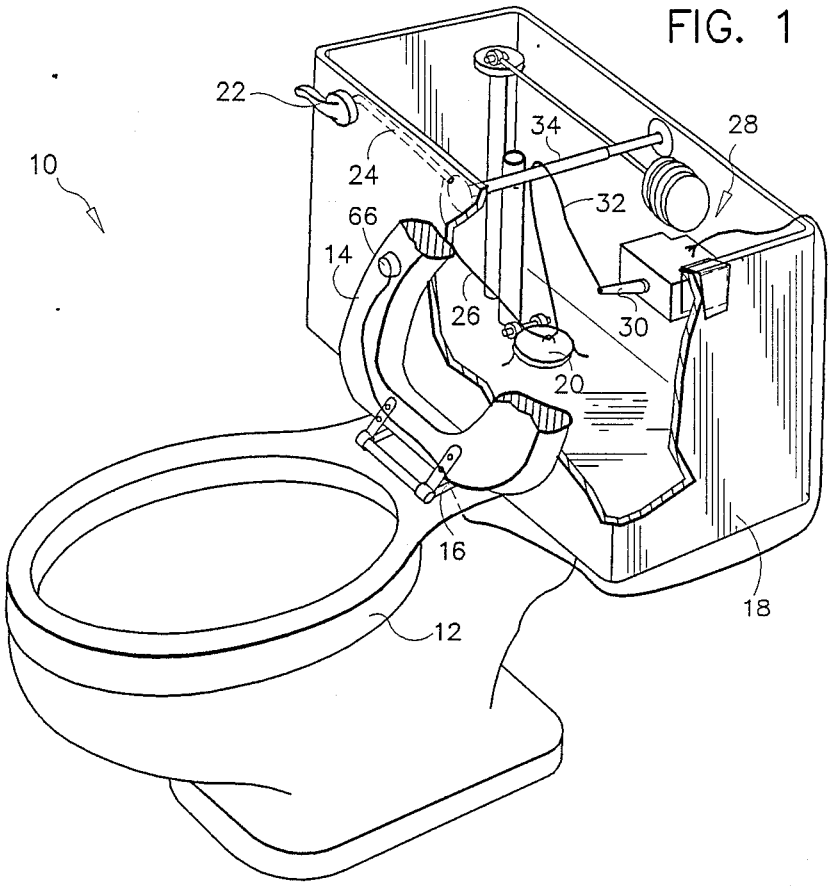
FIG. 1 is a perspective view with portions broken away of a toilet equipped with a flush system in accordance with the invention.

Referring to FIG. 1 of the drawing, a conventional flush toilet is illustrated and designated by the numeral 10. The toilet comprises a bowl 12 having a seat 14 hinged thereto by a hinge 16 in a conventional manner. A flush tank 18 receives and holds a quantity of water for flushing the bowl by means of a conventional valve

20, actuated by a lever 22 connected by an arm 24 and chain 26.

My invention comprises an automatic actuator that is attached to the conventional toilet with no modification of the toilet or its flush mechanism. The toilet can still be flushed by hand in the conventional manner. As illustrated in FIG. 1, the automatic flushing system comprises an actuating mechanism having a rotating arm 30 connected by a flexible connector 32, such as a chain or fishing line or the like, to the flush valve 20. The line 32 is trained over a rod 34, which acts as a pulley for providing the proper direction of the pull of the line on the valve. The rotating arm 30 rotates through one revolution for each cycle of flushing of the bowl. As the arm 30 rotates, it pulls the line 32, which pulls the valve 20 upward off its seat allowing water to rush from the tank for flushing the bowl.

Figure 2:
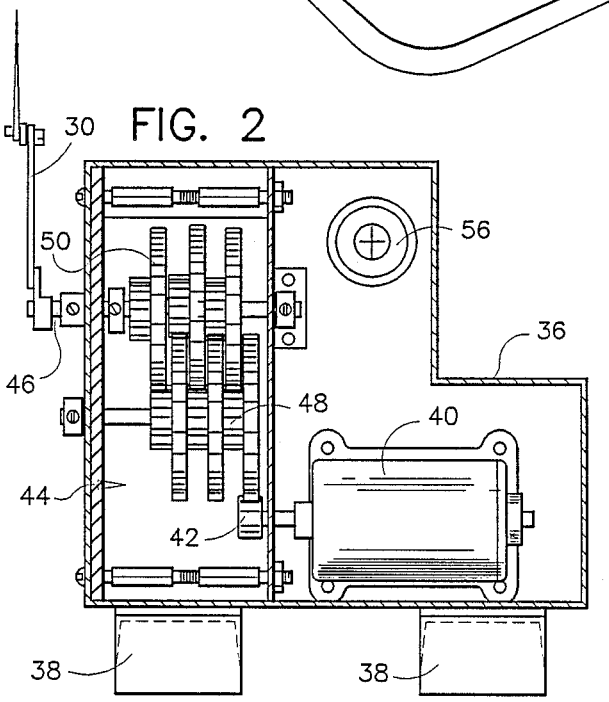
FIG. 2 is a top plan view of the gear drive unit of the invention.
Figure 3:
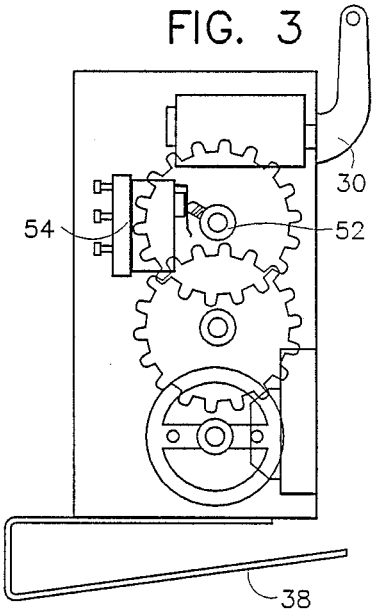
FIG. 3 is a side elevation view of the unit of FIG. 2.

Referring to FIG. 2, the drive mechanism for the arm is illustrated and comprises a housing 36 having mounting clips 38 for mounting the housing over the top edge of the flush tank, as illustrated in FIG. 1. Mounted within the housing 36 is a drive motor 40 drivingly connected by a pinion gear 42 to a gear train 44 driving an output shaft 46 on which the actuating arm 30 is mounted for rotation therewith. The gear train comprises a plurality of spur gear/pinion gear combinations driven by pinion gear 42, and driving a final drive gear 50 which is connected to the output shaft 46. The output shaft 46 also drives a radial cam 52 on the opposite end thereof from the arm, which actuates a micro switch 54 in the control circuit for the system as will be described.

Figure 4:
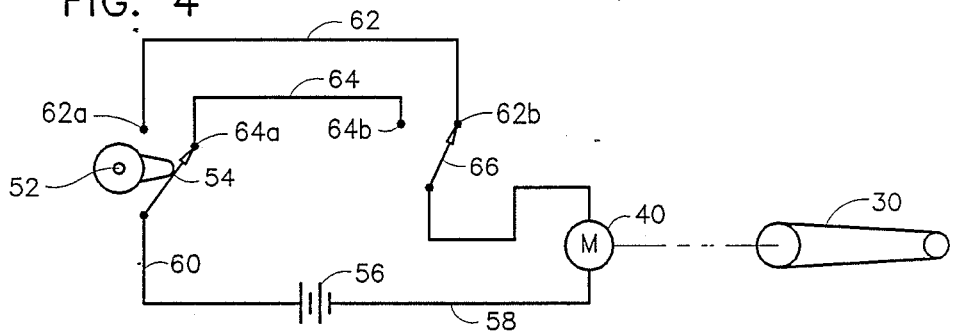
FIG. 4 is a schematic illustration of the circuit of the system shown in a first inactivated state.
Figure 5:
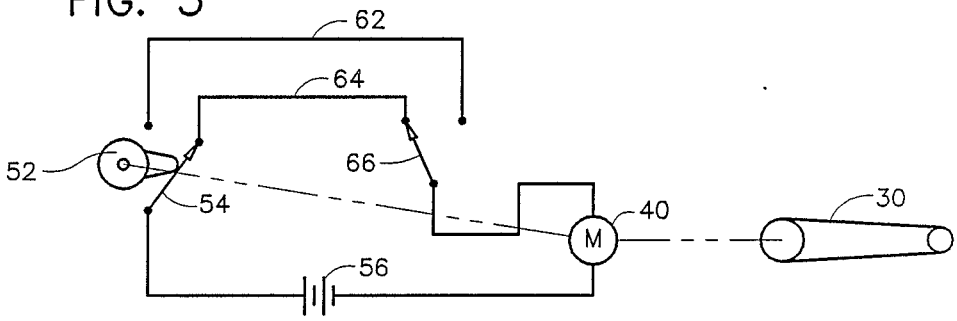
FIG. 5 is a view like FIG. 4 showing the circuit in a first stage of activation.
Figure 6:
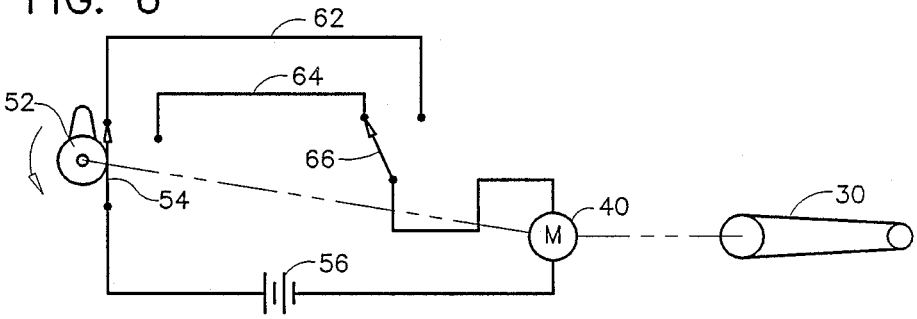
FIG. 6 is a view like FIG. 4 showing the circuit in a second state of inactivation.

The present system includes a control system that cycles through a two stage cycle as it operates to flush a toilet. Referring to FIG. 4, the motor 40 is powered by a suitable source of electrical power, such as a battery 56, connected to the motor by a conductor 58, and a branch circuit comprising a conductor 60 connected to a single pole double throw micro switch 54, which alternately connects through parallel conductors 62 and 64 to a single pole double throw micro switch 66 to the motor 40. The micro switch 66 is mounted on a seat bumper (FIG. 1) so that when the seat is depressed, the switch will be activated or biased to its alternate position. The micro switch 66 is normally biased to the position, as shown in FIG. 4, to contact **62*b* and is biased by pressure or depression of the seat to the position shown in FIG. 5. The micro switch 54 is normally biased to the position engaging contact 62*a*, as shown in FIGS. 5 and 6, but is biased by cam 52 to the position engaging contact 64*a*, as shown in FIGS. 4 and 5**.

In operation, the circuit is normally at rest, as shown in FIG. 4, after a flush cycle has been completed and the toilet is unoccupied. As soon as someone is seated on the seat 14, micro switch 66 mounted on one of the seat bumpers is depressed and moved to the position, as shown in FIG. 5, closing circuit branch 64 along with cam actuated switch 54. This supplies electrical current to motor 40, causing it to operate and drive the gear box 44 so that the output shaft rotates and rotates the cam 52, which after a partial revolution, moves to a position as in FIG. 6., allowing switch 54 to shift from contact **64*a* to contact 62*a* opening the branch circuit 64, stopping the motor 40. This pre-sets the circuit for the flush cycle as shown in FIG. 6**.

Figure 7:
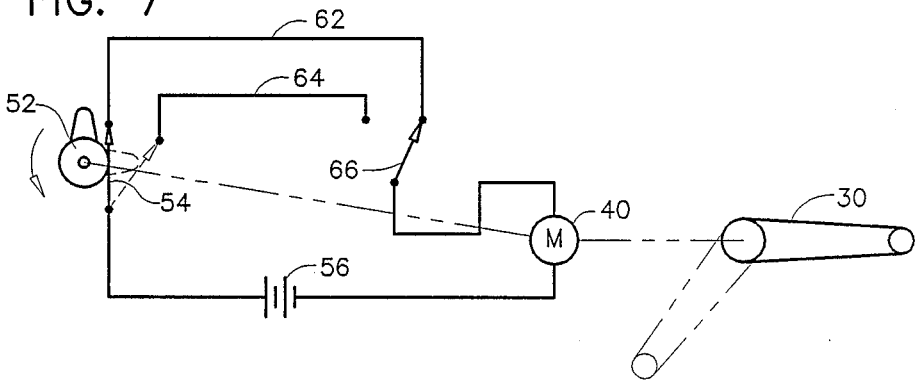
FIG. 7 is a view like FIG. 4 showing the circuit in the operative state.

When the occupant alights from the seat 14, micro switch 66 closes contact **62*b*, as shown in FIG. 7, and the motor 40 is activated and begins driving the gear train, which drives the flush arm 30, opening the flush valve as it reaches a position of about as shown in phantom. The motor continues to operate until cam 52 has rotated to a position to bias switch 54 back to contact 54***a*, as shown in FIG. 4, and in phantom in FIG. 7. The control system is now back to rest condition, ready to be actuated for another cycle.

In summary, when the seat is depressed (occupied), the flush circuit becomes readied or armed. When the seat is then released, the flush circuit is activated to flush the toilet and deactivates itself. The system thus moves or operates through two stages for the flush cycle and acts automatically upon the sequential steps of sitting on and alighting from a toilet seat.

While I have illustrated and described my invention by means of a single embodiment, it is to be understood that many changes and modifications may be made in the illustrated embodiment without departing from the scope and content of the invention as defined by the appended claims.

I claim:

1. An automatic flush apparatus for a waste bowl comprising:

an actuating arm;

means for connecting the actuating arm to a flush valve;

power means for operating said actuating arm; and control means for controlling said power means; including first means for mounting on a seat and responsive to a weight on the seat for enabling second means responsive to removal of said weight form said seat for activating said power means for operating said arm, said power means is electrically operated, and said first means includes a first circuit activated by said weight on said seat, and said second means includes a second circuit activated by removal of said weight from said seat.

2. An automatic flush apparatus for a waste bowl according to claim 1 wherein:

said power means comprises a motor, a gear box driven by said motor and connected to said arm.

3. An automatic flush apparatus for a waste bowl according to claim 1 wherein:

said actuating arm is mounted for rotation about an axis;

said power means comprises an electric motor operatively connected to said arm; and said control means includes a source of electrical current and a circuit for connecting said motor to said source, said circuit includes a first switch actuated by depression of said seat for connecting said motor to said source, and a second switch actuated by a cam driven by said motor for disconnecting said motor from said source.

4. An automatic flush apparatus for a waste bowl according to claim 3 wherein:

said circuit includes a pair of parallel branches and said first switch and said second switch alternately switches between said branches for activation of said motor for a ready cycle and for a flush cycle.

5. An automatic flush apparatus for a waste bowl comprising:

an actuating arm;

means for connecting the actuating arm to a flush valve;

power means for operating said actuating arm; and control means for controlling said power means, including first means for mounting on a seat and responsive to a weight on the seat for enabling second means responsive to removal of said weight from said seat for activating said power means for operating said arm, said actuating arm is mounted for rotation about an axis, said power means comprises an electric motor operatively connected to said arm, and said control means includes a source of electrical current and a circuit for connecting said motor to said source, said circuit includes a first switch actuated by depression of said seat for connecting said motor to said source, and a second switch actuated by a cam driven by said motor for disconnecting said motor from said source.

6. An automatic flush apparatus for a waste bowl according to claim 5 wherein:

said circuit includes a pair of parallel branches and said first switch and said second switch alternately switches between said branches for activation of said motor for a ready cycle and for a flush cycle.

7. An automatic flush apparatus for a waste bowl comprising:

an actuating arm;

means for connecting the actuating arm to a flush valve;

power means for operating said actuating arm; and control means for controlling said power means, including first means for mounting on a seat and responsive to a weight on the seat for enabling second means responsive to removal of said weight from said seat for activating said power means for operating said arm, said control means comprises a source of electrical power and circuit means for connecting said source of electrical power to said power means, said circuit means including parallel branches, and said first means comprises a switch shiftable between said branches, and said second means comprises one of said branches.

8. An automatic flush apparatus for flushing a toilet bowl comprising:

an actuating arm mounted for rotating about an axis;

means for connecting the actuating arm to a flush valve of a toilet;

an electric motor operatively connected to said actuating arm; and said control means includes a source of electrical current and a circuit for connecting said motor to said source, said circuit includes a first switch for mounting on a seat and actuated by depression of said seat for connecting said motor to said source, and a second switch actuated by a cam driven by said motor for disconnecting said motor from said source.

9. An automatic flush apparatus for flushing a toilet bowl according to claim 8 wherein:

said circuit includes a pair of parallel branches and said first switch and said second switch alternately switch between said branches for activation of said motor for a ready cycle and for a flush cycle.

10. An automatic flush apparatus for flushing a toilet bowl according to claim 9 comprising:

a housing;

clip means on said housing for hanging said housing on an upper edge of a flush tank of a toilet;

a shaft rotatably mounted in said housing;

said arm is mounted on one end of said shaft;

a cam mounted on the other end of said housing;

reduction drive gear means connecting said motor to said shaft; and a flexible link connecting said arm to said flush valve.

11. An automatic flush apparatus for flushing a toilet bowl according to claim 8 wherein:

said circuit includes a pair of parallel branches, and said first switch and said second switch alternately switch between said branches for activation of said motor for a ready cycle and for a flush cycle.

12. An automatic flush apparatus for flushing a toilet bowl comprising:

a housing;

clip means on said housing for hanging said housing on an upper edge of a flush tank of a toilet;

a shaft rotatably mounted in said housing;

an actuating arm mounted on one end of said shaft for rotation therewith;

a cam mounted on the other end of said shaft for rotation therewith;

an electric motor mounted in said housing;

reduction drive gear means connecting said motor to said shaft;

a flexible link connecting said arm to said flush valve;

means for connecting the actuating arm to a flush valve of a toilet; and said control means includes a source of electrical current and a circuit for connecting said motor to said source, said circuit includes a first switch for mounting on a seat and actuated by depression of said seat for connecting said motor to said source, and a second switch actuated by a cam driven by said motor for disconnecting said motor from said source.

* * * * *